US006363945B1

(12) United States Patent
Roberson

(10) Patent No.: US 6,363,945 B1
(45) Date of Patent: Apr. 2, 2002

(54) CYLINDRICAL HAIR ROLLER COVER HAVING A PROTECTIVE FLAP

(76) Inventor: Frankie Roberson, 90-17 207 St., Queens Village, NY (US) 11428

( * ) Notice: Subject to any disclaimer, the term of this patent is extended or adjusted under 35 U.S.C. 154(b) by 0 days.

(21) Appl. No.: 09/679,648

(22) Filed: Oct. 5, 2000

Related U.S. Application Data

(60) Provisional application No. 60/159,546, filed on Oct. 15, 1999.

(51) Int. Cl.[7] ..... A45D 6/00

(52) U.S. Cl. ..... 132/255

(58) Field of Search ..... 132/210, 222, 132/226, 243, 245, 251, 254, 255, 258, 259; 2/16, 46, 59, 66, 125, 126, 170, DIG. 11

(56) References Cited

U.S. PATENT DOCUMENTS

| | | | | |
|---|---|---|---|---|
| 2,163,894 A | | 6/1939 | Seidel | |
| 2,171,931 A | | 9/1939 | Gilbert | |
| 2,330,128 A | | 9/1943 | Urs | |
| 2,491,001 A | * | 12/1949 | Croonborg | 2/93 |
| 2,953,140 A | | 9/1960 | Goff | |
| 3,108,604 A | | 10/1963 | Krull | |
| 3,545,457 A | | 12/1970 | Schepis | |
| 3,572,350 A | | 3/1971 | Adams et al. | |
| 3,595,247 A | | 7/1971 | Campana | |
| 4,022,225 A | | 5/1977 | Kauffman | |
| 4,258,733 A | | 3/1981 | Fulgoni | |
| 4,310,008 A | | 1/1982 | Lalli | |
| 4,854,335 A | | 8/1989 | Lycett | |
| 4,898,194 A | * | 2/1990 | Einspahr | 132/251 |
| 4,993,441 A | | 2/1991 | Hanson | |
| 5,411,040 A | * | 5/1995 | Forrest | 132/211 |
| 5,758,671 A | * | 6/1998 | Thim | 132/273 |
| 5,813,419 A | | 9/1998 | Brams | |
| 5,881,740 A | | 3/1999 | Lehmann | |
| 5,920,909 A | * | 7/1999 | Ellsworth et al. | 2/171 |

FOREIGN PATENT DOCUMENTS

| | | |
|---|---|---|
| GB | 2192786 A | 1/1988 |

* cited by examiner

*Primary Examiner*—John J. Wilson
*Assistant Examiner*—David Comstock
(74) *Attorney, Agent, or Firm*—Richard C. Litman

(57) ABSTRACT

A hair roller cover with a sewn-in silk, satin nylon or spandex flap that easily slides onto a standard hair roller. The hair roller cover includes four sections of fabric sewn together to construct a cylindrically-shaped cover with a flap sewn into either side of the seams of the cylindrical shape. The main purpose of the hair roller cover is to prevent frizzing, kinking and hair breakage of the ends of hair.

13 Claims, 3 Drawing Sheets

CYLINDRICAL HAIR ROLLER COVER HAVING A PROTECTIVE FLAP

CROSS-REFERENCE TO RELATED APPLICATION

This application claims the benefit of U.S. Provisional patent application Ser. No. 60/159,546, filed Oct. 15, 1999.

BACKGROUND OF THE INVENTION

1. Field of the Invention

The present invention relates to a hair roller cover with a flap, and more specifically, a hair roller cover that slides onto a hair roller.

2. Description of Related Art

Hairdressers for a long time have been trying to perfect curling hair without damaging or frizzing the ends. Many curler devices and techniques have been the subject matter of hair curling in the past. The following patents describes different types of hair curlers and rollers.

U.S. Pat. No. 2,163,894, issued to Clara Seidel on Jun. 27, 1939, describes hair curlers which hair may be curled to produce the effect of Croquignole marcelling or produce paper curls. The hair curler uses either a rigid or flexible mandrel in combination with a winding pad where the ends of the hair are wound up on the mandrel of the curl. U.S. Pat. No. 2,953,140, issued to Gordon S. Goff on Sep. 20, 1960, describes a molding rod for hair waving. The device is a circular rod in cross-section throughout its operative length. Hair wound around the rod assumes the circular shape of the rod's transverse cross-section.

U.S. Pat. No. 3,108,604, issued to Ruth M. Krull on Oct. 29, 1963, describes corrugated disposable paper or cardboard hair curler. The curlers have longitudinal corrugations forming channels adapted to receive bobby pins to prevent hair from unrolling from the roller. U.S. Pat. No. 4,022,225, issued to Robert T. Kauffman on May 10, 1977, describes a coil curler. The curler includes an elongated tape rigid in a width direction and flexible in a length direction. It also has an elongated coil spring extending the length of the curler with adjustable clamps for anchoring around hair to be curled. U.S. Pat. No. 4,258,733, issued to Jean-Claude Fulgoni on Mar. 31, 1981, describes a method for permanent waving and means for practicing the method. The method is only for the permanent waving of hair at the roots by enveloping the portion of the hair not to be treated with a flexible sheet wound in a fluid-tight manner.

U.S. Pat. No. 4,310,008, issued to Mary S. Lalli on Jan. 12, 1982, describes a hair roller having tubular netting surrounding a soft cylindrical member and soft tabs that are mutually adherent when in contact with one another. U.S. Pat. No. 4,854,335, issued to Norma Lycett on Aug. 8, 1989, describes a hair curler system. The system includes a flexible tubing used with a flare member and a male coupling member. The system is used for rolling and looping a curl having different incremental diameters along its length. More than one flare member can be used in the combination described above.

U.S. Pat. No. 4,993,441, issued to Luther B. Hanson on Feb. 19, 1991, describes a permanent wave rod. The rod is a cylindrically-shaped member formed of a readily wettable rigid polymeric material. The rods may be secured to a person's head by connecting each rod to an adjacent rod through the use of rubber bands or an elongated strip of material. U.S. Pat. No. 5,813,419, issued to Patrick Brams on Sep. 29, 1998, describes a hair curler made of a sheet with perforations. The sheets have been folded of first time lengthwise forming a central fold and then folded in zigzag perpendicularly to the central fold.

U.S. Pat. No. 5,881,740, issued to Roger W. Lehmann on Mar. 16, 1999, describes a hair curling device and method of use. The curler has an elongated rod, an elongated pressure applicator, and a pivotable connector enabling the rod to be pivoted from an open position. The method utilized in this patent causes the hair to take a curl without the necessity of heat. The curler also includes a catch member for releasable holding the rod in the closed position. Great Britain Pat. No. 2,192,786A, issued on January 1988, describes hair curling rolls comprising of a hollow cylindrical body provided with a plurality of slots with each adapted to receive a sheet of paper. A sheet of paper extends through the center of the roller body in a slot. The problem with most curler and roller is that they are equipped with bristles or brushlike objects which protrude and cause a pinch or poke to the scalp of the user's head.

The following patents describes attachments that aids the curler or method of curling hair. U.S. Pat. No. 2,171,931, issued to William A. Gilbert on Sep. 5, 1939, describes a protector pad for permanent waving. The device consists of a flattened tubular arrangement of layers of cellulose material having a longitudinal slot. The device is fabricated with a plurality of transverse embossments. U.S. Pat. No. 2,330,128, issued to Mary Lou Urs on Sep. 21, 1943, describes spacers for hair waving for impressing curls of different types in different parts of the strands of hair. The spacers are made of flexible, absorbent, and porous materials. Strands are wound around the spindle and a spacer is placed about the spindle. Then another portion of the strand is wound around the spindle and another spacer is added.

U.S. Pat. No. 3,545,457, issued to Nunziato Schepis on Dec. 8, 1970, describes hair curling packages which are flexible and can be formed into a roll when used. Each package is in the form of an envelope having outer water repellent layers, inner aluminum foil layers, and an intermediate absorbent layer. U.S. Pat. No. 3,572,350, issued to Gail A. Adams and Paul B. Adams on Mar. 23, 1971, describes a hair curler protective device for a hair curler. The device includes a resilient C-shaped inner sleeve and a C-shaped spongeous outer sleeve. The device is adapted to be slipped over the curler when the curler is wound onto a person's hair to provide protection against the curler and the person's head.

U.S. Pat. No. 3,595,247, issued to William Anthony Campana on Jul. 27, 1971, describes hair roller pads for protecting the head of the user from being pinched or poked by hair rollers. The pad is a thin rectangular-shaped member having an elongated slot adjacent to one end. The pad contains a rectangular slot for a hair tress to pass through. The biggest problem that hairdressers face is when hair is curled by roller, the ends of the hair strands will not properly curl or the hair strands will frizz and kink. An ideal curler would evenly permit strands of hair to be rolled onto the curler without kinking or frizzing hair strand ends.

None of the above inventions and patents, taken either singly or in combination, is seen to describe the instant invention as claimed.

SUMMARY OF THE INVENTION

The present invention is a hair roller cover design to prevent the ends of strands of hair from kinking or frizzing, and hair breakage when being wound around a roller. The hair roller cover comprises of a fabric cylindrically-shaped to fit any sized hair roller with a flap member sewn into one of the ends of the cylindrical shape. The preferred fabric used for the hair roller cover is a silk sleeve and flap; satin, nylon and spandex materials are suitable alternatives to silk.

The hair roller cover is adaptable to be easily slid onto any hair roller with the flap opening to the left or right to accommodate most hairdressers who are faster at rolling hair depending on if they are faster with their left or right hand. The preferred fabrics used for the hair roller cover are silk, satin, nylon and spandex to aid in curling the ends of hair without frizzing or producing kinks and hair breakage in the opposite direction to the curl.

Accordingly, it is a principal object of the invention to provide a hair roller cover that curls the ends of hair without frizzing the ends or producing kinks in the opposite direction to the curl.

It is another object of the invention to provide a hair roller cover which increases the speed to which hair is rolled onto hair rollers.

It is a further object of the invention is to provide a hair roller cover that cushions and prevents the rough outer edges of most rollers from being in contact with the person's head which could cause abrasions or cuts.

Still another object of the invention is to provide a hair roller cover which easily slides onto most standard hair rollers.

It is an object of the invention to provide improved elements and arrangements thereof a hair roller cover in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
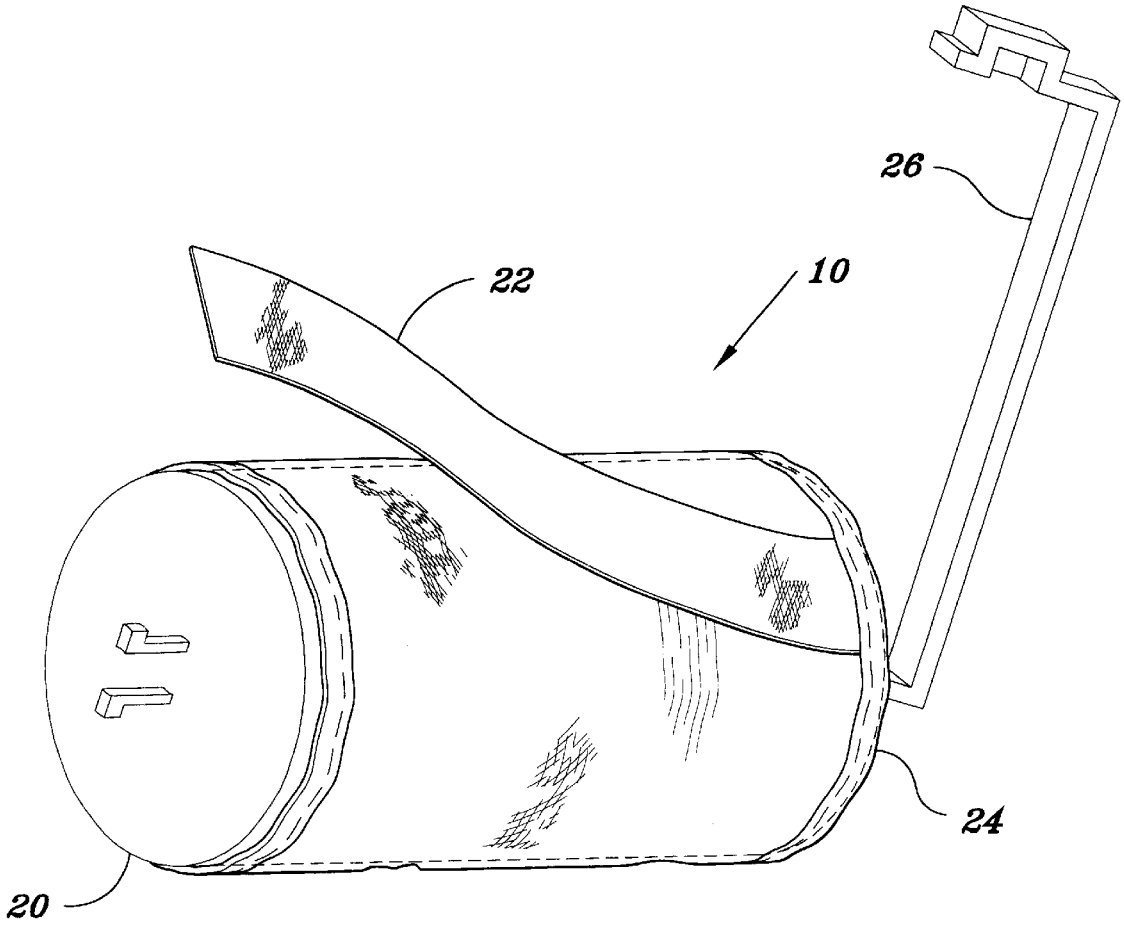
FIG. 1 is an environmental, perspective view of a hair roller cover on a hair roller according to the present invention.

The present invention is a hair roller cover designated as 10 in the drawings. The hair roller cover is design to prevent the ends of strands of hair from kinking or frizzing and hair breakage when being wound around a roller. FIG. 1 illustrates hair roller cover 10 which comprises a fabric cylindrically-shaped to fit any sized hair roller 20 with a flap 22 member sewn into one of the seams 24 of the cylindrical shape. Although the hair roller cover 10 can be dimensioned and configured to snugly fit over, either removably or permanently, the outer surface of any standard roller 20 on the market, the most preferred roller 20 is the cylindrically-shaped roller 20 with a closing rod-like member 26 attached to one end of the roller 20 and removably clamped to the other end.

Figure 2:
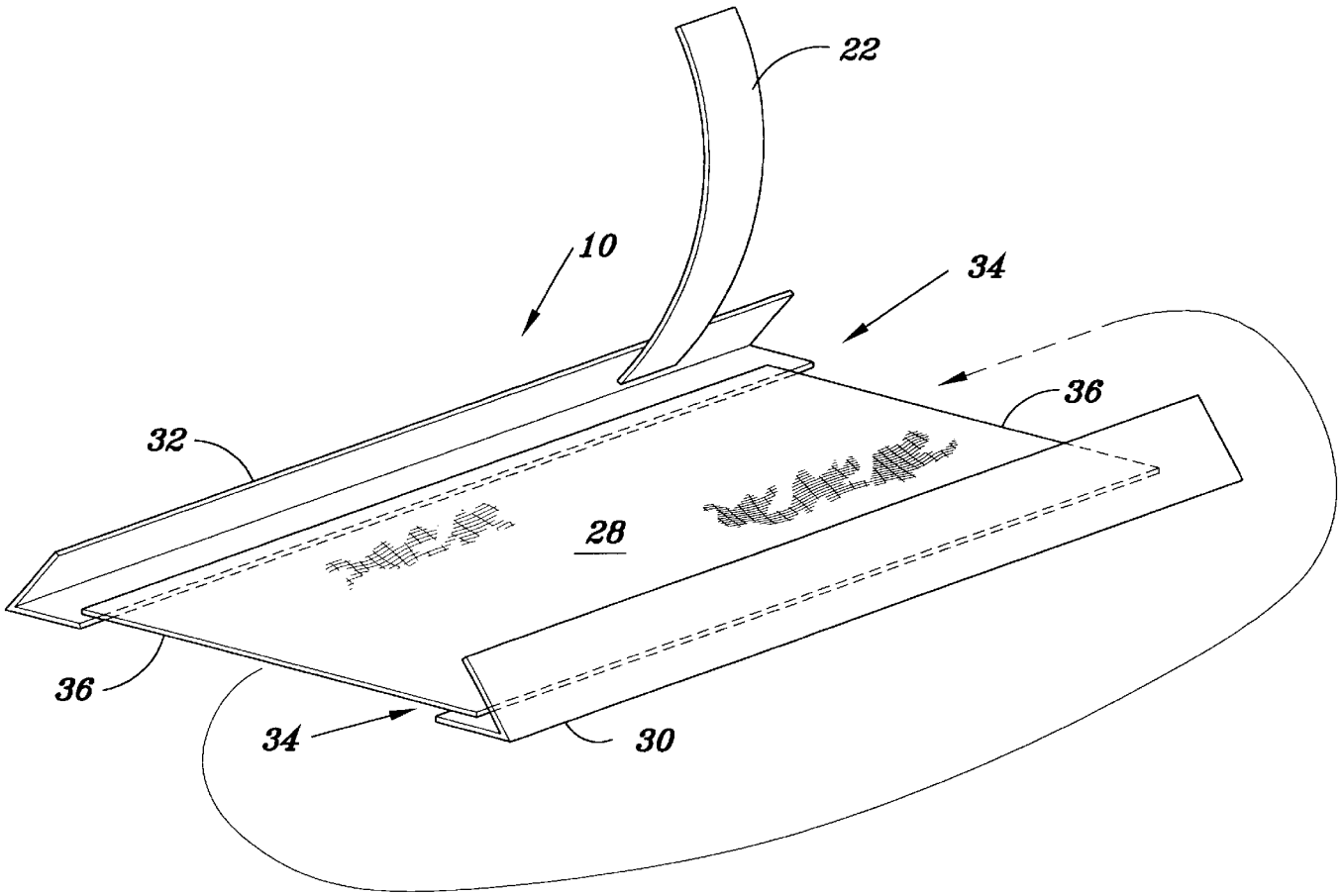
FIG. 2 is an exploded perspective view illustrating how the fabric strips are sewn together of the present invention.

FIG. 2 illustrates the hair roller cover 10 which is comprised of four sections 28, 30, 32, and 22 of fabric dimensioned and configured to be cylindrically-shaped to fit over a hair roller 20. The first section 28 of the hair roller cover 10 is a cut in a rectangular shape. The first section 28 of fabric comprise the center portion of the hair roller cover 10 and is where the hair tress is wound upon. The first section 28 of fabric has two seam sides 34 and two ends 36. The second 30 and third 32 sections of fabric comprise the seams of the hair roller cover 10 and are foldably sewn into each of the seam sides 34 of the first section 28.

The second 30 and 32 third sections of fabric act to cushion and prevent the rough outer edges of most rollers 20 from being in contact with the person's head which could cause abrasions or cuts. The fourth section 22 of fabric (also referred to as the "flap" 22) is sewn in between either one of the second 30 or third 32 sections and first section 28 of fabric. Finally, the two ends 36 of the first section 28 are sewn together and are dimensioned and configured to easily slide onto most standard hair rollers 20. It is contemplated that the invention is also effective in the absence of a fourth section.

The hair roller cover 10 is typically comprised of a soft heat-resistant-type fabric. However, the preferred fabric used for the entire hair roller cover 10 would be silk. Satin, nylon and spandex are suitable alternative materials. It does not matter if the second 30 or third 32 section is used to sew in the flap 22 because when the hair roller cover 10 is slid onto the hair roller 20, the flap 22 can be opened to the left or the right. It is important to be able to have the hair roller cover 10 adaptable to be slid onto the hair roller 20 with the flap 22 opening to the left or right one simple reason. Rolling hair onto a roller 20 is very time consuming and most hairdressers are faster at this method with either their left or right hand. The flap 22 also replaces the need for a separate sheet of tissue paper and acts to secure the hair tress to the hair roller 20 and hair roller cover 10.

The hair roller 20 and hair roller cover 10 are rotated toward the ends of the hair to simultaneously wind up to cause the hair ends to be held between the flap 22 and the first section of material 28. When the ends of the hair tress is evenly and neatly slid between the flap 22 and the first section 28 of the hair roller cover 10, the user will continue rolling up hair in the same direction until wind up the entire strand of hair to be curled. The hair roller 20 will include a rod-like structure 26 which is used to secure the hair tress wound onto the hair roller 20 and hair roller cover 10. The purpose of the silk, satin, nylon or spandex flap 22 is to provide a curling device that will curl the ends of hair without frizzing the ends or producing kinks and hair breakage in the opposite direction to the curl.

Figure 3:
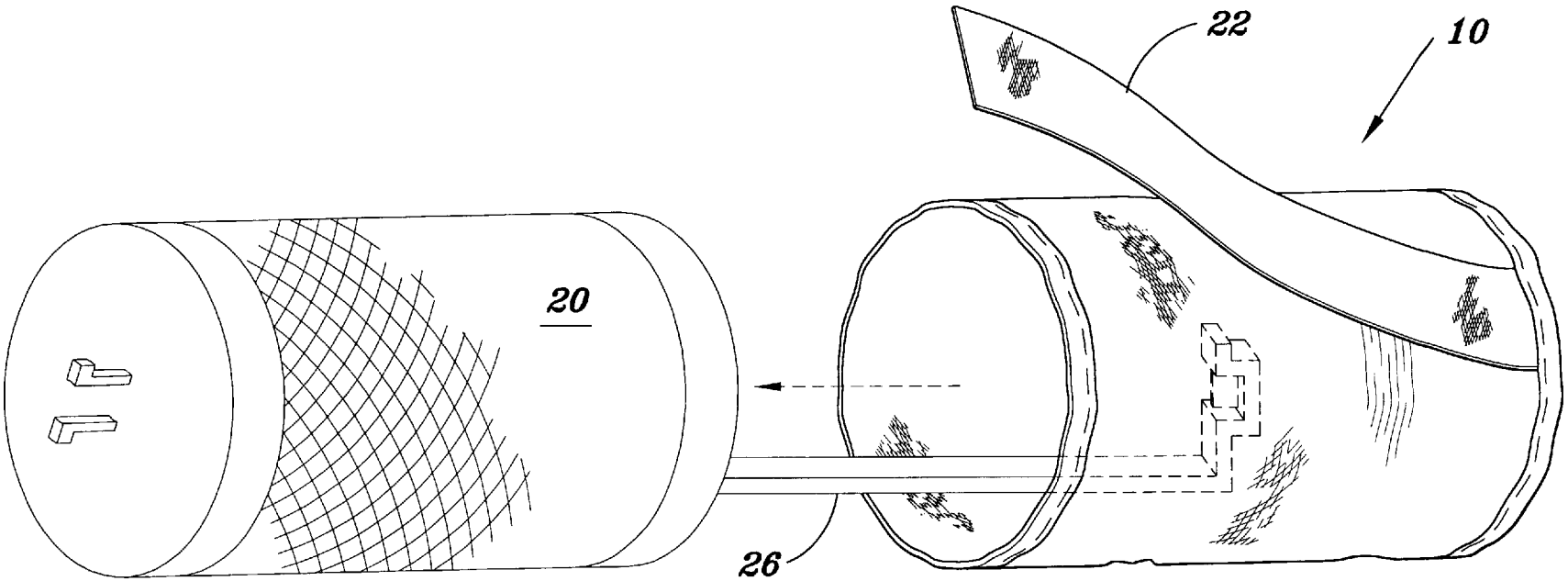
FIG. 3 is an environmental, perspective view illustrating how the hair roller cover slides onto the hair roller of the present invention.

FIG. 3 illustrates how the hair roller cover 10 snugly fits over the outer surface of a hair roller 20. The hair roller cover 10 may be permanently or removably attached to the hair roller 20. In the latter case, it is removed for washing or to reposition the silk, satin, nylon or spandex flap 22 onto the hair roller 20 where the flap 22 is arranged to a desirable left or right opening. The hair roller cover 10 diameters and lengths differ for each circular arrangement of any standard hair roller 20 on the present market. The hair roller cover 10 can be adapted for home use and hair salons. The hair roller cover 10 can be also be adapted for greater and shorter length hair rollers 20 and is especially useful in connection with the extremely large diameter hair rollers 20 that are presently being utilized in the curling of hair. The silk, satin, nylon or spandex fabric can be used for rolling hair wet, dry or when applying heat.

It is to be understood that the present invention is not limited to the sole embodiment described above, but encompasses any and all embodiments within the scope of the following claims.

I claim:

1. A hair roller cover which snugly fits over a hair roller with a rod-like clamp, the hair roller cover comprising:

a cylindrically-shaped fabric dimensioned and configured to easily fit over the outer surface of a hair roller; and a rectangular flap of fabric having a length running in the same direction as a longitudinal axis of said cylindrically-shaped fabric, said rectangular flap dimensioned and configured to equal the length of a hair roller to hold a tress of hair between said cylindrically-shaped fabric and said flap to prevent the ends of a tress of hair from frizzing or kinking and hair breakage.

2. A hair roller cover according to claim 1, wherein said cylindrically-shaped fabric and said flap of fabric are made from one or more of silk, satin, nylon and spandex materials.

3. A hair roller cover according to claim 1, wherein said cylindrically-shaped fabric and said flap of fabric are made of heat-resistant material.

4. A hair roller cover according to claim 1, wherein said cylindrically-shaped fabric and said flap of fabric are each dimensioned and configured to snugly fit a predetermined size diameter and length of a hair roller.

5. A hair roller cover according to claim 1, wherein said cylindrically-shaped fabric and said flap of fabric are colored to indicate the size of a roller with which the cover is to be used.

6. A hair roller cover according to claim 1, wherein said hair roller cover is configured so as to be slid onto a hair roller to position a flap opening at a left end of said cylindrically-shaped fabric.

7. A hair roller cover according to claim 1, wherein said hair roller cover is configured so as to be slid onto a hair roller to position a flap opening at a right end of said cylindrically-shaped fabric.

8. A hair roller cover which snugly fits over a hair roller with a rod-like clamp, the hair roller cover comprising:

a first section of fabric having a rectangular shape which is dimensioned and configured to cover the outer surface of a hair roller, said first section having two seam sides and two ends, said ends of said first section being sewn together to construct a cylindrical shape;

a second and third section of fabric dimensioned and configured to be foldably sewn as the seam on the seam sides of said first section, said first, second, and third sections being dimensioned and configuredly sewn to construct a cylindrically-shaped piece of fabric to be easily slid onto a hair roller; and a fourth section of fabric dimensioned and configured to equal the length of a hair roller, said fourth section being sewn into one of said second or third sections, said fourth section for holding a tress of hair between said cylindrically-shaped fabric and said fourth section for preventing the ends of a tress of hair from frizzing or kinking and hair breakage.

9. A hair roller cover according to claim 8, wherein said cylindrically-shaped fabric and said fourth section of fabric are made from one or more of silk, satin, nylon and spandex materials.

10. A hair roller cover according to claim 8, wherein said cylindrically-shaped fabric and said fourth section of fabric are made of heat-resistant material.

11. A hair roller cover according to claim 8, wherein said cylindrically-shaped fabric and said fourth section of fabric are dimensioned and configured to snugly fit a predetermined size diameter and length of a hair roller.

12. A hair roller cover according to claim 8, wherein said hair roller cover is configured so as to be slid onto a hair roller to position said fourth section of fabric at a left end of said cylindrically-shaped fabric.

13. A hair roller cover according to claim 8, wherein said hair roller cover is configured so as to be slid onto a hair roller to position said fourth section of fabric at a right end of said cylindrically-shaped fabric.

* * * * *